US010289065B2

(12) United States Patent
Zhou

(10) Patent No.: US 10,289,065 B2
(45) Date of Patent: May 14, 2019

(54) DRIVING FORCE RECEIVING MODULE AND PROCESS CARTRIDGE USING THE MODULE

(71) Applicant: ZHUHAI UN-TERN IMAGING PRODUCTS CO., LTD, Zhuhai (CN)

(72) Inventor: Honghui Zhou, Zhuhai (CN)

(73) Assignee: ZHUHAI UN-TERN IMAGING PRODUCTS CO., LTD, Zhuhai (CN)

( * ) Notice: Subject to any disclaimer, the term of this patent is extended or adjusted under 35 U.S.C. 154(b) by 0 days.

(21) Appl. No.: 15/956,720

(22) Filed: Apr. 18, 2018

(65) Prior Publication Data

US 2018/0239299 A1 Aug. 23, 2018

Related U.S. Application Data

(63) Continuation-in-part of application No. PCT/CN2017/083819, filed on May 10, 2017.

(30) Foreign Application Priority Data

May 27, 2016 (CN) ..... 2016 2 0507475 U
Sep. 6, 2016 (CN) ..... 2016 2 1041224 U

(51) Int. Cl.
*G03G 21/18* (2006.01)
*G03G 15/00* (2006.01)
*G03G 21/16* (2006.01)

(52) U.S. Cl.
CPC ..... *G03G 21/1853* (2013.01); *G03G 15/5008* (2013.01); *G03G 15/757* (2013.01);
(Continued)

(58) Field of Classification Search
CPC ..... G03G 21/1853; G03G 21/1857; G03G 15/757; G03G 2221/1657
See application file for complete search history.

(56) References Cited

U.S. PATENT DOCUMENTS 8,615,184 B2 * 12/2013 Zhou ..... G03G 15/757 399/111
2015/0177683 A1 * 6/2015 Gu ..... G03G 21/1857 399/111

(Continued)

FOREIGN PATENT DOCUMENTS

CN 201532527 U 7/2010
CN 103809420 A 5/2014

(Continued)

*Primary Examiner* — Sandra Brase
(74) *Attorney, Agent, or Firm* — Gokalp Bayramoglu

(57) ABSTRACT

A driving force receiving module includes: a power receiving component which engages with the engaging component of the driving head of the image forming apparatus; a driving cooperating component which cooperates with the driven rotating component; The driving force receiving module is engaged with the driving head in that the minimum of L, which represents the distance between any two points on the projected area of the two symmetrically arranged power receiving components on the plane perpendicular to the assembly direction of the process cartridge, ranges between D/2 and D+H, including end values; where D is the maximum outer diameter of the rotating head perpendicular to the rotating axis of the driving head, and H is the height of the most outer point on the contour of driving head protruding out of the assembly location of the engaging component.

18 Claims, 10 Drawing Sheets

(52) U.S. Cl.
CPC ..... *G03G 21/1647* (2013.01); *G03G 21/1857* (2013.01); *G03G 15/751* (2013.01); *G03G 2221/1657* (2013.01)

(56) References Cited

U.S. PATENT DOCUMENTS

| | | | | |
|---|---|---|---|---|
| 2016/0124383 | A1* | 5/2016 | Ikeda | G03G 21/1839 399/111 |
| 2016/0370750 | A1* | 12/2016 | Ikeda | G03G 15/757 |
| 2017/0146952 | A1* | 5/2017 | Ikeda | F16D 1/10 |

FOREIGN PATENT DOCUMENTS

| | | | |
|---|---|---|---|
| CN | 204406035 | U | 6/2015 |
| CN | 105589318 | A | 5/2016 |
| CN | 105843008 | A | 8/2016 |
| CN | 205787599 | U | 12/2016 |
| CN | 106444316 | A | 2/2017 |
| CN | 206075004 | U | 4/2017 |
| WO | 2016006667 | A1 | 1/2016 |

* cited by examiner

DRIVING FORCE RECEIVING MODULE AND PROCESS CARTRIDGE USING THE MODULE

CROSS REFERENCE TO RELATED APPLICATIONS

This application is a Continuation-In-Part application of International Application PCT/CN2017/083819, filed on May 10, 2017, which is based upon and claims priority to Chinese Patent Application No. 201620507475.4, filed on May 27, 2016 and Chinese Patent Application No. 201621041224.8, filed on Sep. 6, 2016, the entire contents of which are incorporated herein by reference.

TECHNICAL FIELD

The present invention involves the process cartridge used in laser printer, copier or the fax machine. More specifically, it involves the driving force receiving module used in the process cartridge.

BACKGROUND

An electrophotographic image forming apparatus, such as a laser printer, copier, and fax machine, usually has a process cartridge which can be detached from the electrophotographic image forming apparatus. There are mainly the following types of process cartridges: the photosensitive drum and the developing device, the integrated cartridge in which the charging device and the cleaning device are set up together, the split cartridge in which the photosensitive drum and the charging device are set up together or the split cartridge in which the photosensitive drum and the developing device are set up together. Both the integrated process cartridge and the split process cartridge are provided with driving force receiving module for receiving the rotating driving force from the driving head of the image forming apparatus at the end of the photosensitive drum.

In the prior art, the process cartridges produced by some manufacturers use a gimbal structure for the driving force receiving module, which is more expensive. There are also some manufacturers which use the mechanical auxiliary swing arm structure for the driving force receiving module in the process cartridges, and realize the engagement and disengagement between the driving force receiving module and the driving head during the assembly/disassembly process of process cartridges through the axial stretching; or use the door cover of the image forming apparatus to push the swinging rod and realize the engagement and disengagement between the driving force receiving module and the driving head through the axial stretching of driving force receiving module. The process cartridges produced by some other manufacturers adopt the forced assembly/disassembly to realize the engagement and disengagement between the driving force receiving module and the driving head.

Using the swinging rod to assist the stretching or the door cover to assist the pushing of the swinging rod depends on the structure of the image forming apparatus, which is subject to poor compatibility and the problem of assembly unsmooth or disassembly difficulty; for the process cartridges which adopt forced assembly or disassembly, at some angles, the drive module cannot be engaged with the driving head, causing the slipping problem. Moreover, for the process cartridges which use the swinging rod to assist the stretching, or the door cover to assist the pushing of the swinging rod, or forced assembly and disassembly, in the assembly/disassembly of process cartridges, the driving head should be in contact with the driving claws of the driving force receiving module. In the case of unsuitable position, it is difficult for the driving claws of the driving force receiving module to be engaged with the driving head.

SUMMARY

The purpose of the present invention is to provide a driving force receiving module that is stable in structure, smooth assembly, the force transmission stably and reliably for the process cartridges.

In order to achieve the above purpose, the present invention adopts the following technical solutions:

A driving force receiving module which is used for receiving the rotating force from the driving head of the image forming apparatus and transmitting the rotating force to the driven rotating component, thus driving the driven rotating component to rotate, including:

At least two symmetrically arranged power receiving components which are engaged with the engaging component of the driving head of the image forming apparatus;

A driving cooperating component which cooperates with the driven rotating component;

A power transmitting component which connects the power receiving component and the driving cooperating component;

Wherein, the driving force receiving module is engaged with the driving head in that the minimum of L, which represents the distance between any two points on the projected area of the two symmetrically arranged power receiving components on the plane perpendicular to the assembly direction of the process cartridge, ranges between D/2 and D+H, including end values; where D is the maximum outer diameter of the rotating head perpendicular to the rotating axis of the driving head, and H is the height of the most outer point on the contour of driving head protruding out of the assembly location of the engaging component.

Further, the driving force receiving module is engaged with the driving head by the fixed angle formed by the assembly direction of the process cartridge and the perpendicular intersecting line passing through the force receiving point of the power receiving component and the rotating center line of the power transmitting component.

Further, the angle ranges between 30° and 90°, excluding end values.

Further, a position adjusting device is set up between the power transmitting component and the driving cooperating component, one end of the position adjusting device is connected with the power transmitting component and the other end is connected with the driving cooperating component; the position adjusting device accumulates its swing potential so that the driving force receiving module is engaged with the driving head by the fixed angle formed by the assembly direction of the process cartridge and the perpendicular intersecting line passing through the force receiving point of the power receiving component and the rotating center line of the power transmitting component.

Further, the driving force receiving module wherein the driving cooperating component has a receiving cavity set up along its axis, and the power transmitting component is set up in the receiving cavity with its upper part protruding out of the receiving cavity.

A position adjusting device is set up between the power transmitting component and the driving cooperating component, one end of the position adjusting device is connected with the power transmitting component and the other end is connected with the driving cooperating component.

Further, the gear cover of the process cartridge is set up with a position adjusting device which includes a swinging rod set up on the gear cover through a rotation shaft, a contact block movable in a plane perpendicular to the rotating center line of the power transmitting component, a connecting rod connected with the contact block, and a resetting component to reset the connecting rod; the contact block is located in a sliding groove of the swinging rod;

The connecting rod contacts with the power transmitting component under the impact of the swinging rod and the contact block.

In order to achieve the above purpose, the present invention can adopt the following technical solutions:

A driving force receiving module which is used for receiving the rotating force from the driving head of the image forming apparatus and transmitting the rotating force to the driven rotating component, thus driving the driven rotating component to rotate, including:

A power receiving component which engages with the engaging component of the driving head of the image forming apparatus;

A driving cooperating component which cooperates with the driven rotating component;

A power transmitting component which connects the power receiving component and the driving cooperating component;

Wherein, the driving cooperating component has a receiving cavity set up along its axis, and the power transmitting component is set up in the receiving cavity with its upper part protruding out of the receiving cavity;

A position adjusting device is set up between the power transmitting component and the driving cooperating component, one end of the position adjusting device is connected with the power transmitting component and the other end is connected with the driving cooperating component.

Further, the gear cover of the process cartridge is set up with a position adjusting device which includes a swinging rod set up on the gear cover through a rotation shaft, a contact block movable in a plane perpendicular to the rotating center line of the power transmitting component, a connecting rod connected with the contact block, and a resetting component to reset the connecting rod; the contact block is located in a sliding groove of the swinging rod;

The connecting rod contacts with the power transmitting component under the impact of the swinging rod and the contact block.

Further, the connecting rod contacts with the power transmitting component under the impact of the swinging rod and the contact block so that the driving force receiving module is engaged with the driving head by the fixed angle formed by the assembly direction of the process cartridge and the rotating center line of the driving head and the perpendicular intersecting line passing through the force receiving point of the power receiving component and the rotating center line of the power transmitting component.

Further, the angle ranges between 30° and 90°, excluding end values.

Further, the driving force receiving module wherein the driving cooperating component drives the driven rotating component to rotate unidirectionally.

Further, the cooperating component includes the first assembly component cooperating with the power transmitting component, and the second assembly component cooperating with the driven rotating component; the first assembly component has a receiving cavity set up along its axis while the outer wall of the second assembly component is set up with an outward protruding fixed component cooperating with the driven rotating component, the first assembly component is set up above the second assembly component, and they are engaged by the surface gear in unidirectional engagement.

Further, a unidirectional limiting component is set up on the driving cooperating component and protrudes out of its surface, an elastic limiting component is set up inside the driven rotating component whose position corresponds with that of the unidirectional limiting component, the elastic limiting component enables the driving cooperating component to drive the driven rotating component to rotate unidirectionally.

Further, an axial limiting structure is set up inside the photosensitive drum, and, between the driving cooperating component and the inner wall of the driven rotating component.

Further, an axial force device is set up between the driving cooperating component and the driven rotating component.

Further, a limiting adjusting device is set up on the gear cover, and a limiting protrusion in contact with the limiting adjusting device is set up on the power transmitting component, the limiting adjusting device is pushed against the limiting protrusion to make the axis of the power transmitting component and the driven rotating component overlap.

Further, the driving force receiving module wherein the driven rotating component is a photosensitive drum or a developing roller.

Another purpose of the present invention is to provide a process cartridge with smooth assembly.

In order to achieve the above purpose, the present invention can adopt the following technical solutions:

A process cartridge which can be detachably mounted to the host of an image forming apparatus, including the driving force receiving module.

Based on above technical solution, the present invention by engaged with the driving head in that the minimum of L, which represents the distance between any two points on the projected area of the two symmetrically arranged power receiving components on the plane perpendicular to the assembly direction of the process cartridge, ranges between D/2 and D+H, including end values; so that a space is formed in the power receiving component, which the driving head can enter smoothly, providing stable transmission of driving force.

Particularly, the present invention by forming a fixed angle between the assembly direction of the process cartridge and the perpendicular intersecting line passing through the force receiving point of the power receiving component and the rotating center line of the power transmitting component so that a space is formed in the power receiving component, which the driving head can enter smoothly, providing stable transmission of driving force. Particularly, the process cartridge is set up with a position adjusting device, after the process cartridge is assembled and about to come into contact with the driving head, the power receiving component can be in a specific position to realize smooth assembly of the process cartridge.

BRIEF DESCRIPTION OF THE DRAWINGS

To describe the embodiments of the present invention more clearly, the attached drawings required in the description of the embodiments or the prior art will be briefly introduced hereunder. Apparently, the attached drawings in the following description merely show some embodiments of the present invention. For the ordinary technical staff in this field, they can obtain other drawings based on these attached drawings without creative efforts.

The specific embodiments of the present invention are described in further details hereunder with reference to the attached drawings.

DETAILED DESCRIPTION

Embodiment 1

Figure 1:
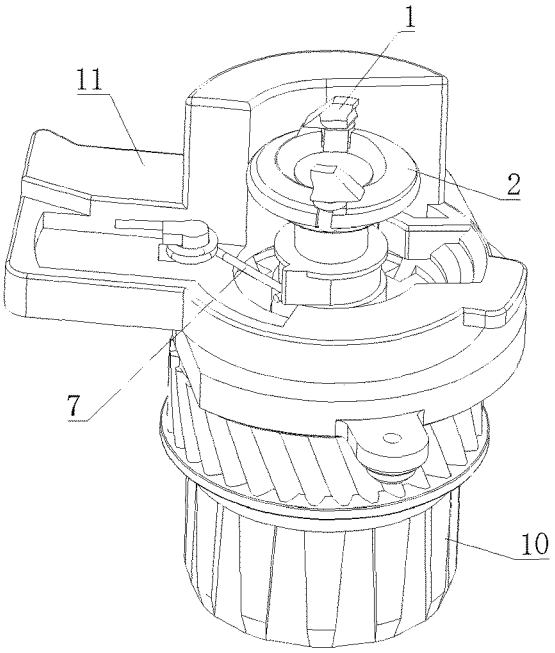
FIG. 1 is a structural schematic of the driving force receiving module assembled with a gear cover and a photosensitive drum gear in the Embodiment 1 of the present invention.
Figure 2:
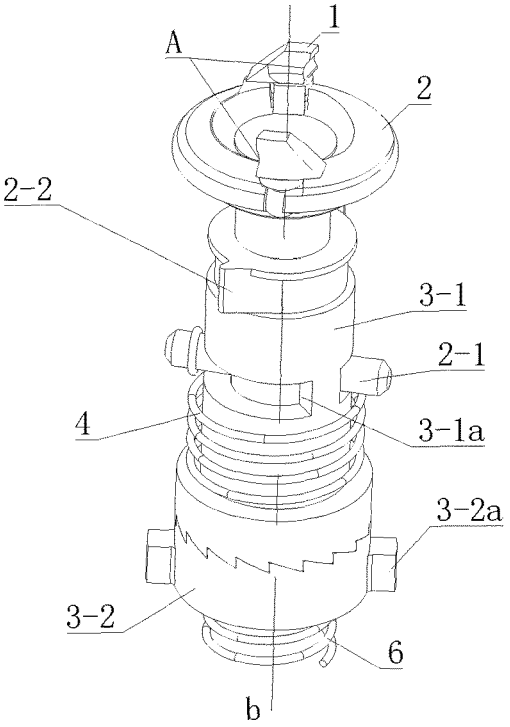
FIG. 2 is a structural schematic of the driving force receiving module in the Embodiment 1 of the present invention.
Figure 3:
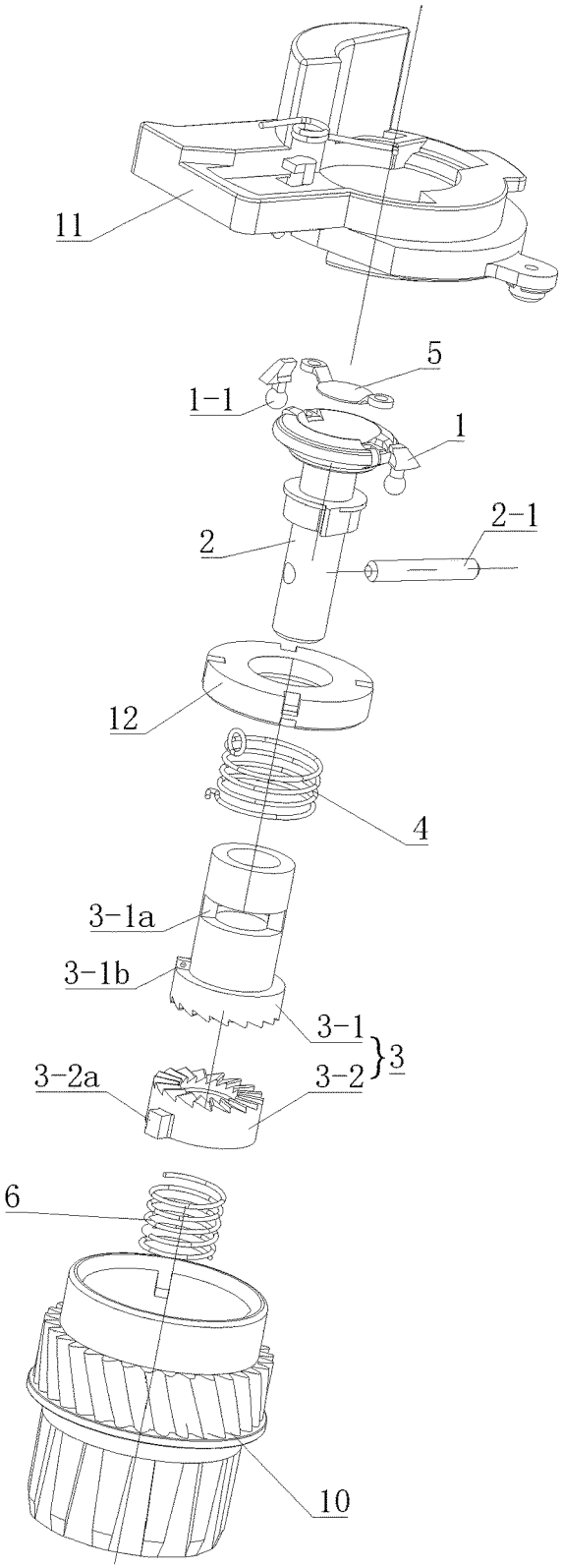
FIG. 3 is a decomposed structural schematic of the driving force receiving module in the Embodiment 1 of the present invention.

As shown in FIG. 1, FIG. 2 and FIG. 3, the driving force receiving module in the Embodiment 1 of the present invention includes a power receiving component 1, a power transmitting component 2, a driving cooperating component 3, and a position adjusting device. The driving force receiving module in the Embodiment 1 of the present invention is used for receiving the rotating force of the driving head in the image forming apparatus, transmitting the rotating force to the photosensitive drum through the photosensitive drum gear set up at the end of the photosensitive drum and driving the photosensitive drum to rotate. This rotating force is also transmitted to the other rotating components of the process cartridge through the drum gear set up at the end of the photosensitive drum. The driving cooperating component 3 of Embodiment 1 is a split structure that includes the first assembly component 3-1 cooperating with the power transmitting component 2 and the second assembly component 3-2 cooperating with the photosensitive drum. The second assembly component 3-2 of the Embodiment 1 cooperates with the inner wall of the photosensitive drum gear 10 set up at the end of the photosensitive drum. In addition, it can directly cooperate with the photosensitive drum to transmit the driving force to the photosensitive drum and drive the photosensitive drum to rotate.

A pair of symmetrically arranged power receiving component 1 are symmetrically arranged on the power transmitting component 2. The power receiving component 1 protrudes upwards from the power transmitting component 2, and is used for engaging with the driving head in the image forming apparatus and receiving power from the image forming apparatus. The rotating center line (axis) of the driving force receiving module (power transmitting component) overlaps with the axis of the photosensitive drum. The driving force receiving module may include multiple pairs of symmetrically arranged power receiving component 1. When multiple pairs of symmetrically arranged power receiving component 1 are engaged with the engaging component of the driving head, only one pair of the symmetrically arranged power receiving component 1 are selected to be engaged with the engaging component of the driving head. Since the power receiving component is symmetrically arranged, the line connecting the force receiving point A (the contact point with the driving head) of the two power receiving components is inevitably perpendicularly intersected with the rotating center line b (axis) of the driving force receiving module (power transmitting component).

As a preferred embodiment of the present invention, the bottom of the power receiving component 1 in the present embodiment is a spherical hinge component 1-1, and is hinged to the power transmitting component 2 through the hinge component 1-1. When subjected to force, the power receiving component 1 can rotate around the hinge point so that the tiny position adjustment can be performed when the driving force receiving module and the driving head are disengaged to further facilitate the detachment of the power receiving component from the driving head. In the meanwhile, an elastic rebounding device 5 is set up between the two power receiving components 1. Two ends of the rebounding device 5 are respectively connected to the power receiving components 1, which are fixed by the elastic force. When the power receiving components 1 rotate around the hinge point to complete the disengagement from the driving head, they can be restored to the original position by the elastic force of the rebounding device 5. The rebounding device 5 of the present embodiment adopts a metal shrapnel. Mounting holes are formed on both ends of the metal shrapnel to cooperate with the power receiving component. Two ends of the metal shrapnel are sleeved over the hinge component 1-1 of the power receiving component 1, and connected to the power receiving component 1. The rebounding device may also adopt an elastic structure, such as a spring, a rubber spring, or a rubber ring, which can provide a force for resetting the power receiving component.

A plug pin 2-1 is set up on the power transmitting component 2, at the middle and lower part of the power transmitting component in the present embodiment. The plug pin 2-1 passes through the power transmitting component 2 and its axis is perpendicular to the axis of the transmitting component 2. In addition, its ends protrude from the surface of the power transmitting component and its axis is perpendicular to the axis of the power transmitting component, which can also be understood as another implementation of the plug pin. The position adjusting device of the present embodiment is a torsion spring 4, which provides the rotating force (pre-rotating force) of the power transmitting component. One end of the torsion spring 4 is fixed on the plug pin 2-1 (ie, the power transmitting component), and the other end of the torsion spring 4 is fixed on the driving cooperating component 3. The plug pin is used for receiving the rotating force of the power transmitting component and for position limiting. The first assembly component 3-1 of the present embodiment is a cylinder with a receiving cavity set up along its axis. The power transmitting component 2 is inserted into the receiving cavity of the first assembly component 3-1 with its upper part protruding out of the first assembly component 3-1. The power transmitting component 2 can rotate around its own axis within the first assembly component 3-1. The torsion spring 4 is sleeved outside the first assembly component 3-1.

The first assembly component 3-1 is set up above the second assembly component 3-2, and they are connected by a unidirectionally engaged surface gear, which means that the bottom surface of the first assembly component and the upper surface of the second assembly component is a unidirectionally engaged gear surface. When the first assembly component rotates in a predetermined driving rotating direction, the engaging relationship with the second assembly component can drive the second assembly component to rotate (FIG. 8 and FIG. 2), thus driving the photosensitive drum to rotate. When the second assembly component rotates in the reverse direction, slipping phenomenon occurs between the second assembly component and the second assembly component so that the second assembly component cannot rotate, thus achieving the unidirectional rotation purpose of the drum.

In the present embodiment, a torsion spring fixing component 3-1*b* is set up on the bottom of the first assembly component 3-1, and the other end of the torsion spring is fixed on the torsion spring fixing component 3-1*b* of the first assembly component 3-1. A pair of outwardly protruding fixing components 3-2*a* are set up on the outer wall of the second assembly component 3-2. A mounting groove (not shown) is set up in the photosensitive drum gear for cooperating with the fixing components 3-2*a*. When the driving cooperating component 3 is mounted in the photosensitive drum gear 10, the fixing components 3-2*a* are set up in the mounting groove in the photosensitive drum gear 10 in order to be assembled and fixed with the photosensitive drum gear. When the second assembly component 3-2 rotates, the photosensitive drum gear can rotate. When the second assembly component is directly cooperating with the photosensitive drum, the mounting groove can be set up on the inner wall of the photosensitive drum, and the driving cooperating component is mounted in the photosensitive drum while the fixing component is set up in the mounting groove to be assembled and fixed with the photosensitive drum. When the second assembly component rotates, the photosensitive drum can rotate.

As a preferred embodiment, in the present embodiment, a through groove is circumferentially set up on the peripheral wall of the first assembly component 3-1 corresponding to the position of the plug pin 2-1. The end wall of the through groove forms the rotating limiting component 3-*la* of the present embodiment. The two ends of the plug pin 2-1 pass through the through groove and protrude out of the first assembly component 3-1. When the power transmitting component 2 rotates along its own axis, the plug pin 2-1 can move in the through groove, and when the plug pin 2-1 reaches the end wall 3-*la* of the through groove, it cannot move alone due to the restriction of the end wall 3-*la* so that the power transmitting component 2 can push the first assembly component 3-1 to rotate.

Figure 4:
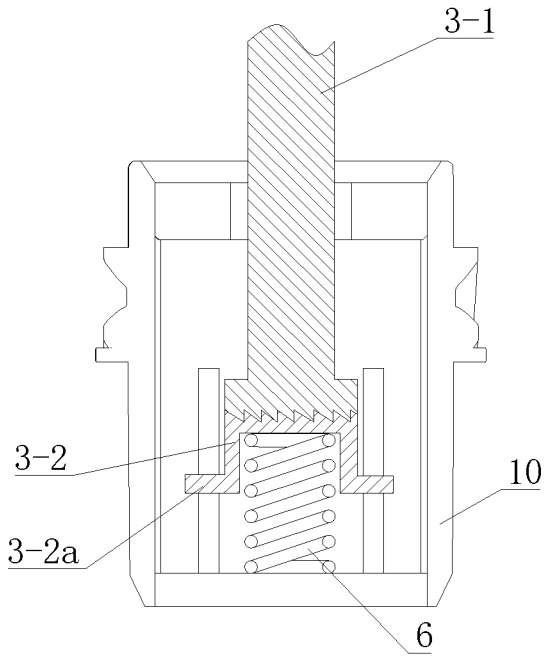
FIG. 4 is a sectional view of the driving cooperating component in the Embodiment 1 of the present invention.

The driving force receiving module is assembled to the photosensitive drum gear 10 through the gear cover 11 and the pressure ring 12, and the photosensitive drum gear 10 is fixed to the end of the photosensitive drum of the process cartridge. The pressure ring 12 serves as an axial limiting structure and is assembled at the second assembly component 3-2 to prevent the driving force receiving assembly from coming out axially by restricting axial movement of the second assembly component. Further, an axial force device 6 is set up between the driving cooperating component 3 and the photosensitive drum gear 10. The axial force device 6 in the present embodiment is a spring which is located between the bottom of the second assembly component 3-2 (the driving engaging component 3) and the end wall of the photosensitive drum gear 10 (FIG. 4). The axial force device 6 can provide axial displacement of the drive force receiving module along the photosensitive drum axis. The axial force device 6 may also be an elastic structure, such as an elastic shrapnel, a rubber spring or rubber ring.

Figure 6:
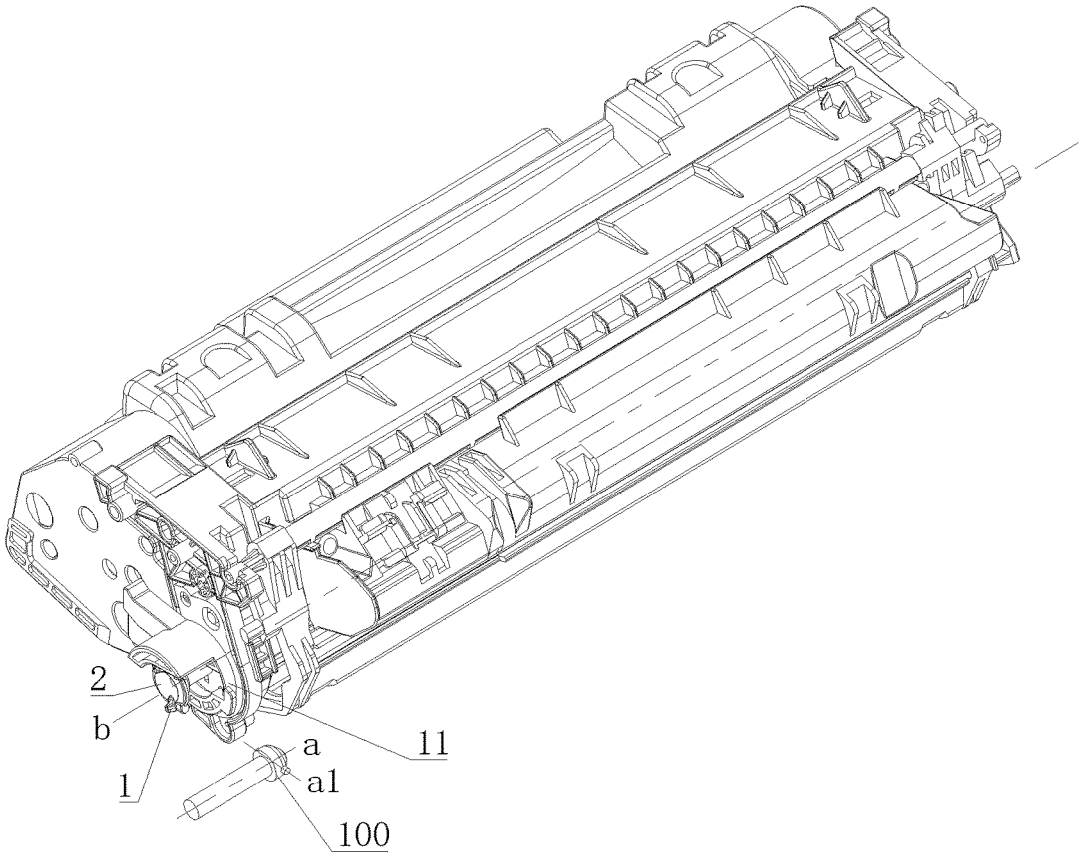
FIG. 6 is a structural schematic when the process cartridge and the driving head are not assembled in the Embodiment 1 of the present invention.

The cooperation process of the driving force receiving module and the driving head of the image forming apparatus in the present invention is described hereunder with reference to the attached drawings. In reference to FIG. 6, FIG. 7A and FIG. 7B, a pair of protruding engaging components 100*a* are generally set up in the driving head 100 of the image forming apparatus, and the driving force is transmitted after the engaging component is engaged with the power receiving component of the driving force receiving module. The connecting line a1 between the center points of the two engaging components 100*a* on the driving head perpendicularly intersects the rotating center line a of the driving head (FIG. 6). It is assumed that the diameter of the driving head 100 is D, the height of the engaging component 100*a* protruding out of the driving head is H, and a in FIG. 7B is the projection of the rotating center line a of the driving head 100 perpendicular to the paper plane (forming the rotating center of the driving head projected on the paper plane), and b is the projection of the rotation center line of the power transmitting component 2 perpendicular to the paper plane (forming the rotating center of the power transmitting component projected on the paper plane). When the process cartridge (driving force receiving module) is mounted into the machine and about to come into contact with the driving head 100, the power transmitting component 2 of the present invention acts on the power transmitting component 2 only by the elastic force of the torsion spring without external force. The position adjusting device uses the elastic structure, such as a torsion spring, to accumulate the rotating potential, and applies a force to the power transmitting component in order to keep the power transmitting component 2 at a predetermined position. The state of the driving force receiving module in the predetermined position when the process cartridge is mounted into the image forming apparatus is defined as the unassembled state.

As shown in FIG. 7B, when the driving force receiving module is in the unassembled state, the projected areas of two power receiving components 1 on the plane S perpendicular to the assembly direction of the process cartridge do not overlap (not intersection or overlapping). In addition, the minimum of L, which represents the distance between any two points on the projected area of the two power receiving components on the plane S perpendicular to the assembly direction of the process cartridge, ranges between D/2 and D+H, including end values. This means that the minimum of L, which represents the distance between any point in one projected area and any point in another projected area on the same projecting plane, ranges between D/2 and D+H, where D is the maximum outer diameter of the rotating head perpendicular to the rotating axis of the driving head, and H is the height of the most outer point on the contour of driving head protruding out of the assembly direction of the engaging component. A force is applied on the power transmitting component 2 to make it rotate at a predetermined position. During the assembly of process cartridge, the driving head 100 can smoothly enter between the two power transmitting components without being caught. The driving force receiving module is engaged with the driving head by that the minimum of L, which represents the distance between any two points on the projected area of the two power receiving components on the plane S perpendicular to the assembly direction of the process cartridge, ranges between D/2 and D+H. Here, the engagement refers to the state in which the driving force receiving module is going to contact with the driving head after the process cartridge is assembled into the image forming apparatus. Under this state, the driving force receiving module is not cooperating with the driving head in contact.

Figure 7A:
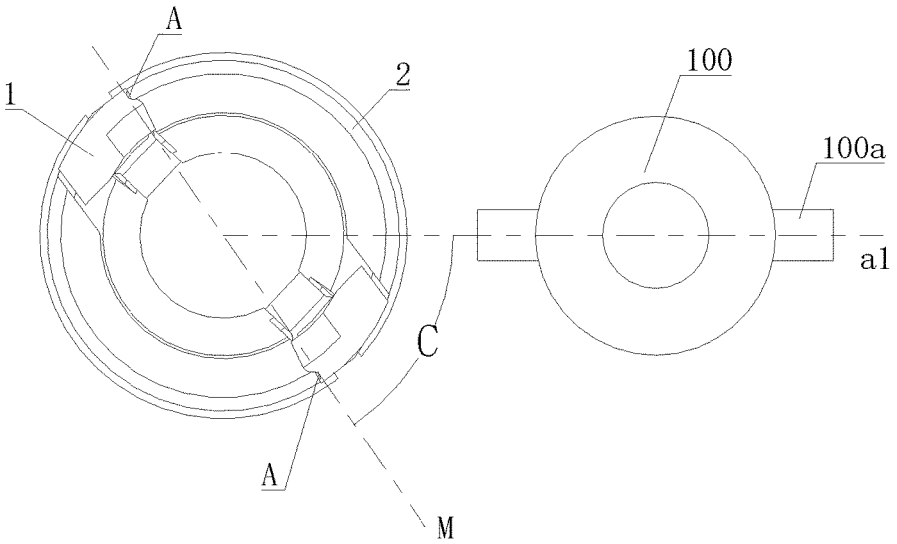
FIG. 7A is a structural schematic when the driving force receiving module and the driving head are not assembled in the Embodiment 1 of the present invention.
Figure 7B:
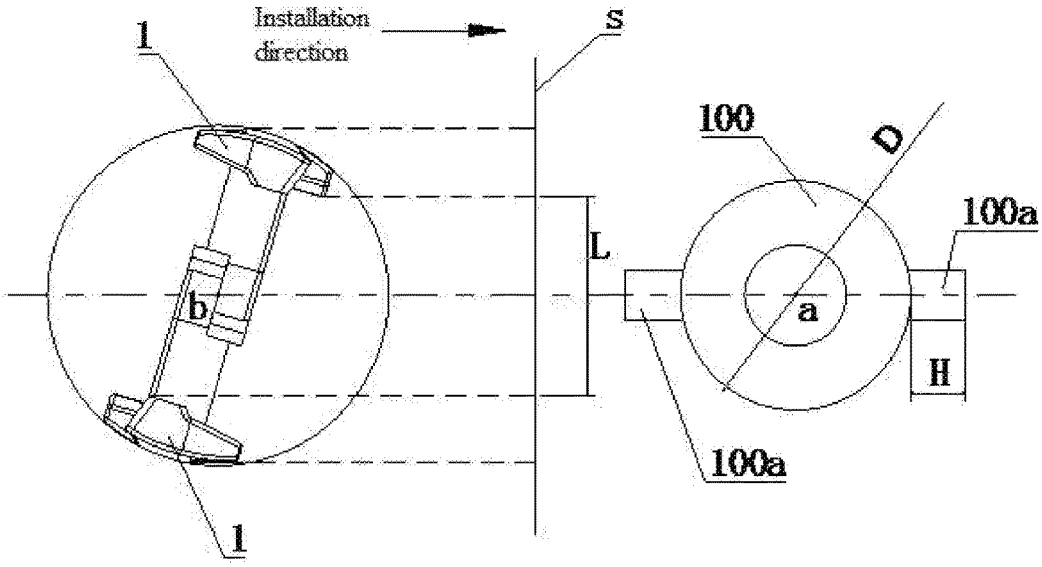
FIG. 7B is another structural schematic when the driving force receiving module and the driving head are not assembled in the Embodiment 1 of the present invention.

As shown in FIG. 7A, when the driving force receiving module is in the unassembled state, on the driving head 100, the connecting line a1 (in accordance with the assembly direction of the process cartridge) between the center points of the two engaging components 100*a* and the connecting line M between the force receiving point A of the two power receiving components 1 form an included angle C, which means that the assembly direction of the process cartridge forms a fixed angle C with the perpendicular intersecting line M between the force receiving point of any power receiving component and the rotating center line of the power transmitting component. In the present embodiment, the projection of the perpendicular intersecting line a1 which passes through the center points of the engaging component and the rotating center line of the driving head overlaps with the perpendicular intersecting line of the rotating center line of the driving head and the rotating center line of the power transmitting component on the plane perpendicular to the rotating center line of the driving head and the rotating center line of the power transmitting component (the projection on the paper plane overlaps in FIG. 7A of the present embodiment). Because of the angle C existing, the driving head 100 can smoothly enter between the two power receiving components 1 without being caught by the power receiving components during the assembly of process cartridge. It is preferred that the clockwise angle C, which is formed by the assembly direction of the process cartridge with the perpendicular connecting line M between the force receiving points A of two power receiving components 1 and the rotating center line of the power transmitting component, ranges between 30° and 90°, excluding end values. The driving force receiving module is engaged with the driving head by the fixed angle formed by the assembly direction of the process cartridge with the perpendicular connecting line M between the force receiving points A of two power receiving components 1 and the rotating center line of the power transmitting component. Here, the engagement refers to the state in which the driving force receiving module is in contact with the driving head after the process cartridge is assembled into the image forming apparatus. Under this state, the driving force receiving module is not cooperating with the driving head in contact.

Figure 8:
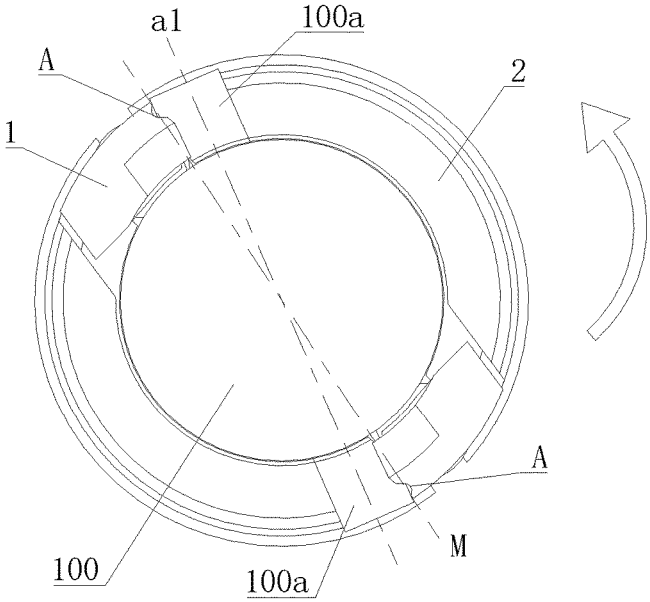
FIG. 8 is a structural schematic when the driving force receiving module and the driving head are assembled in the Embodiment 1 of the present invention.
Figure 9:
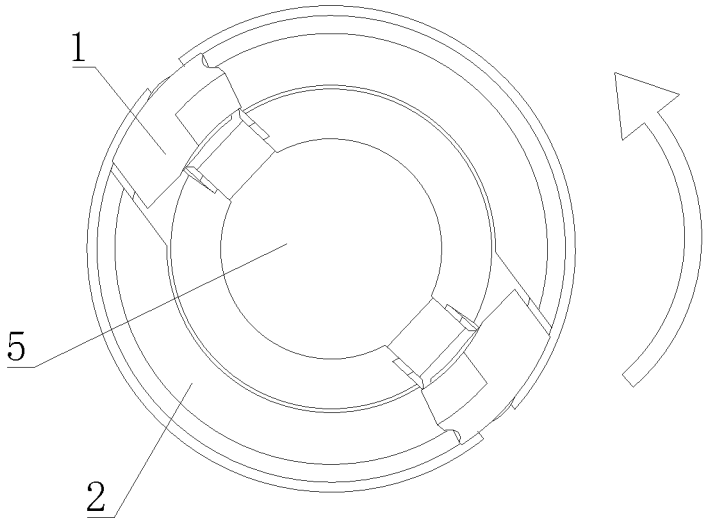
FIG. 9 is a structural schematic for the rotating direction of the driving force receiving module in the Embodiment 1 of the present invention.

After the process cartridge mounted into the image forming apparatus, the driving head 100 firstly rotates for a certain angle. As shown in FIG. 8, with the movement of the driving head 100, the engaging component 100*a* of the driving head comes into contact with the force receiving point of the power receiving component and gets engaged. Thus, the assembly of the driving head and the driving force receiving module is completed. Afterwards, the angle formed by the perpendicular intersecting line a1 which passes through the center point of the engaging component 100*a* and the rotating center line of the driving head with the perpendicular intersecting line M which passes through the force receiving point of the power receiving component and the rotating center line of the power transmitting component. However, during engagement, when the power transmitting component is only subject to the force of the position adjusting device, the angle C formed by the assembly direction of the process cartridge with the perpendicular intersecting line M which passes through the force receiving point of the power receiving component and the rotating center line of the power transmitting component remains unchanged. When the driving head 100 keeps rotating, the power transmitting component 2 rotates, driving the plug pin 2-1 on the power transmitting component 2 to rotate until the plug pin 2-1 moves to the rotating limiting component 3-*la*. Then, the power transmitting component 2 further drives the driving cooperating component 3 to rotate, transmits the rotating driving force of the driving head to the photosensitive drum gear, thus driving the photosensitive drum to rotate by the driving force receiving module.

In the present embodiment, plug pin is set up to fix the torsion spring. Alternatively, the torsion spring can be directly fixed on the power transmitting component 2 if the power transmitting component can be provided with the rotating force so that the angle C formed by the assembly direction of the process cartridge with the perpendicular intersecting line M which passes through the force receiving point of the power receiving component and the rotating center line of the power transmitting component remains unchanged, and/or, the projected areas of the two power receiving components 1 on the plane S perpendicular to the assembly direction of the process cartridge do not overlap, and the minimum of L, which represents the distance between any two points on the two projected areas, ranges between D/2 and D+H. Apart from the torsion spring, other elastic structures, such as shrapnel and rubber ring, can be adopted. In the present invention, the angle C formed by the assembly direction of the process cartridge with the perpendicular intersecting line M which passes through the force receiving point of the power receiving component and the rotating center line of the power transmitting component remains unchanged. This phenomenon is not randomly formed in assembly process. Because of the angle C existing, a space can be form which the driving head can smoothly pass through during the engagement of the power receiving component of the driving force receiving module and the driving head. Therefore, the driving head will not be caught with the driving force receiving module, thus ensuring smooth assembly of process cartridge.

Figure 5:
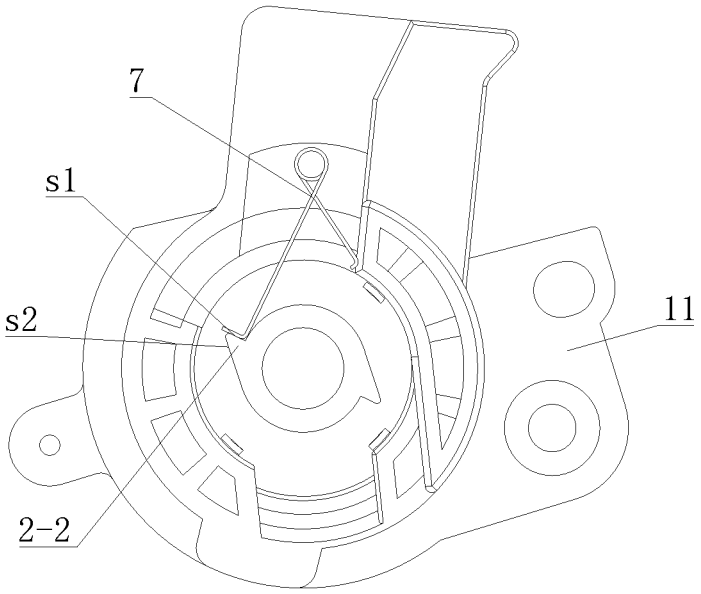
FIG. 5 is a structural schematic of the position adjusting device in the Embodiment 1 of the present invention.

In reference to FIG. 5, further, the present embodiment includes limiting adjusting device 7, which is a jump ring fixed on the gear cover 11. One end of the jump ring is abutted against the side wall of the gear cover. A limiting protrusion 2-2 is set up on the power transmitting component 2 and protrudes out of the outer wall. The other end of the jump ring is abutted against the limiting protrusion 2-2 of the power transmitting component 2. The limiting adjusting device is used for adjusting the position of the power transmitting component and the photosensitive drum axis. The limiting protrusion 2-2 includes the primary surface s1 abutted by the jump ring and the secondary surface s2 connected with the top of the primary surface. Both the primary and secondary surfaces are connected with the side surface of the power transmitting component. When the primary surface s1 is the front of the limiting protrusion, the secondary surface s2 is the back of the limiting protrusion. The primary surface s1 is the limiting abutting surface. In the present embodiment, the primary surface s1 is radially set up along the power transmitting component 2 while the secondary surface s2 is a slope and extends from the primary surface s1. One end of the jump ring is abutted against the primary surface s1 of the limiting protrusion 2-2 to avoid the axis of the power transmitting component 2 from deviating from the axis of the photosensitive drum; besides, when the power transmitting component 2 is rotating, as the secondary surface s2 is a slope, the end of jump ring can smoothly pass along the secondary surface s2 without being caught.

Embodiment 2

Figure 10:
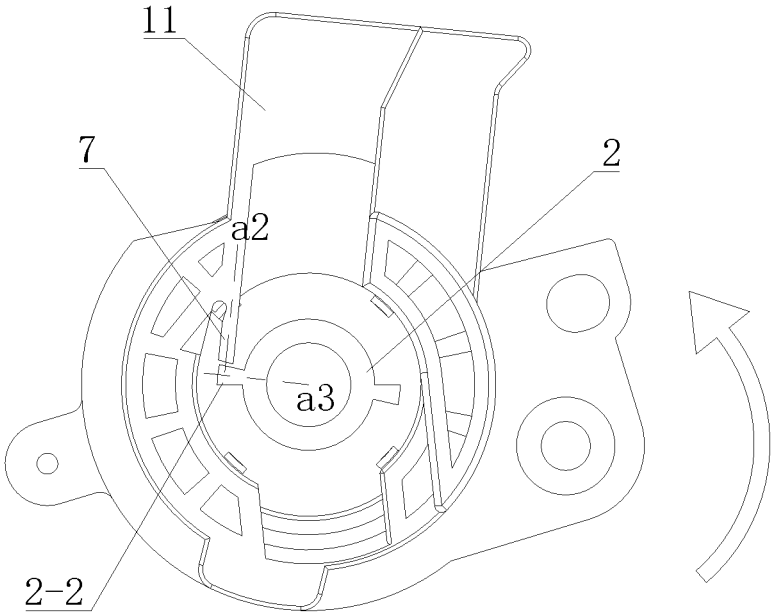
FIG. 10 is a structural schematic for the Embodiment 2 of the present invention.

As shown in FIG. 10, the direction indicated by the arrow refers to the predetermined rotating driving direction. The difference of the present embodiment from Embodiment 1 is that the limiting adjusting device 7 in the present embodiment is an elastic swing arm with one end fixed on the gear cover 11. The swing arm is made of elastic materials, such as metal shrapnel or rubber. A limiting protrusion 2-2 is set up on the power transmitting component 2 and protrudes out of its outer wall. The cross section of the limiting protrusion 2-2 perpendicular to the axis of the power transmitting component of the present embodiment is trapezoid, or rectangular. The angle formed by the axis a2 the elastic swing arm and the connecting line between the rotating center line of the limiting protrusion and the rotating center line of the power transmitting component ranges between 0° and 90° in the rotating direction of the power transmitting component. One end of the elastic swing arm is fixed on the gear cover 11. During the rotation of the power transmitting component 2, when the limiting protrusion 2-2 passes through the elastic swing arm, the elastic swing arm is protruded outwards by the limiting protrusion 2-2 so that the limiting protrusion 2-2 can smoothly pass through the elastic swing arm. When the limiting protrusion 2-2 leaves the elastic swing arm, the elastic swing arm returns to its original position under its own elastic force. When the power transmitting component 2 stops rotating, the free end of the elastic swing arm is pushed against on the limiting protrusion 2-2 to limit the position.

Embodiment 3

Figure 11:
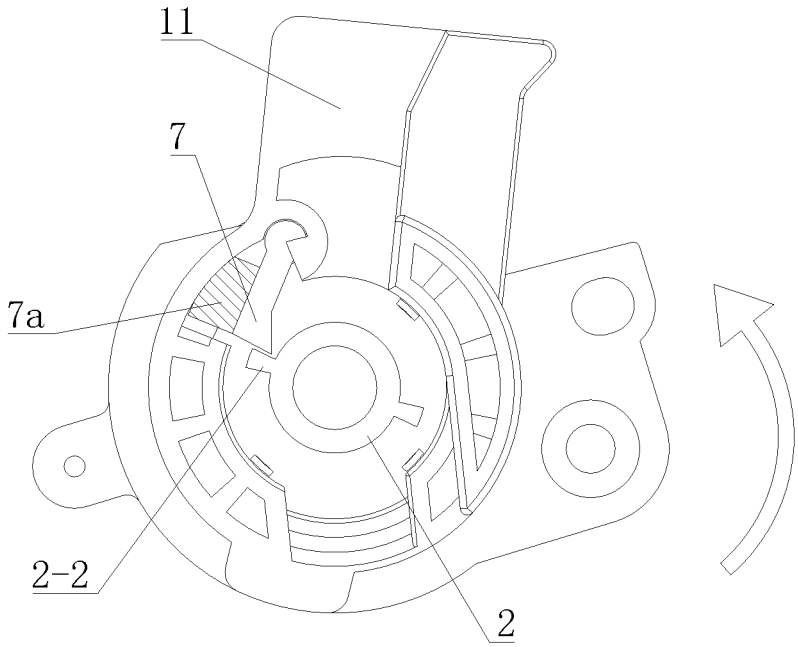
FIG. 11 is a structural schematic for the Embodiment 3 of the present invention.

As shown in FIG. 11, the direction indicated by the arrow refers to the predetermined rotating driving direction. The difference of the present embodiment from Embodiment 2 is that the limiting adjusting device includes the rotating swing arm 7 and the elastic structure 7*a*. The rotating swing arm 7 is hinged onto the gear cover 11 and rotates around the hinge point. The elastic structure 7*a* is set up between the rotating swing arm and the side wall of the gear cover, connected with the rotating swing arm and the side wall of the gear cover separately. The angle formed by the axis a2 the rotating swing arm and the connecting line between the rotating center line of the limiting protrusion and the rotating center line of the power transmitting component ranges between 0° and 90° in the rotating direction of the power transmitting component. During the rotation of the power transmitting component 2, when the limiting protrusion 2-2 passes through the rotating swing arm, the rotating swing arm is protruded outwards by the limiting protrusion 2-2 so that the limiting protrusion 2-2 can smoothly pass through the rotating swing arm. When the limiting protrusion 2-2 leaves the rotating swing arm, the rotating swing arm returns to its original position under the impact of the elastic structure 7*a*. When the power transmitting component 2 stops rotating, the free end of the rotating swing arm is pushed against on the limiting protrusion 2-2 to limit the position.

Embodiment 4

Figure 12:
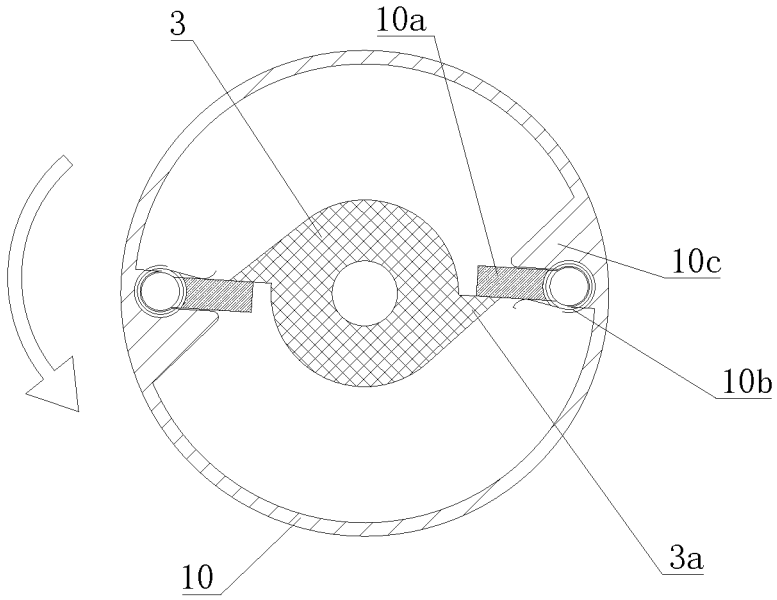
FIG. 12 is a structural schematic for the Embodiment 4 of the present invention.

As shown in FIG. 12, the direction indicated by the arrow refers to the predetermined rotating driving direction. The difference of the present embodiment from Embodiment 1 is that the driving cooperating component 3 is an integrated structure, on which a unidirectional limiting component 3*a* is set up and protrudes outwards. A pair of symmetrically arranged unidirectional limiting components 3*a* is set up on the driving cooperating component 3 in the present embodiment. An elastic limiting component 10*a* is set up in the photosensitive drum gear 10 at a position corresponding to that of the unidirectional limiting component 3*a* of the driving cooperating component 3. The elastic limiting component 10*a* is hinged to the mounting component 10*c* of the inner wall of the photosensitive drum gear 10, and can rotate around the hinge point of the elastic limiting component 10*a*. An elastic structure 10*b* is set up between the elastic limiting component 10*a* and the mounting component 10*c*. The elastic force of the elastic structure 10*b* acts on the elastic limiting component 10*a* to make it in contact with the mounting component 10*c*. The moving direction when the elastic limiting component 10*a* is approaching the component portion 10*c* is the predetermined driving rotating direction while the moving direction when the elastic limiting component 10*a* is getting away from the mounting component 10*c* is opposite to the predetermined driving rotating direction.

The mounting component 10*c* protrudes from the inner wall of the photosensitive drum gear 10. When the driving cooperating component 3 rotates in the predetermined driving rotating direction and turns to the unidirectional limiting component 3*a* to contact with the elastic limiting component 10*a*, the unidirectional limiting component 3*a* will be blocked by the elastic limiting component 10*a* and the mounting component 10*c*, thus driving the photosensitive drum gear 10 to rotate. When the driving cooperating component 3 does not rotate (reversely rotating) in the driving rotating direction and turns to the unidirectional limiting component 3*a* to contact with the elastic limiting component 10*a*, the unidirectional limiting component 3*a* can push the elastic limiting component 10*a* so that the unidirectional limiting component 3*a* can pass through the elastic limiting component 10*a*. When the unidirectional limiting component 3*a* leaves, the elastic limiting component 10*a* returns under the elastic force of the elastic structure 10*b*. In this case, the driving cooperating component 3 cannot drive the photosensitive drum gear 10 to rotate, thus achieving the unidirectional rotation purpose of the photosensitive drum.

Embodiment 5

Figure 13:
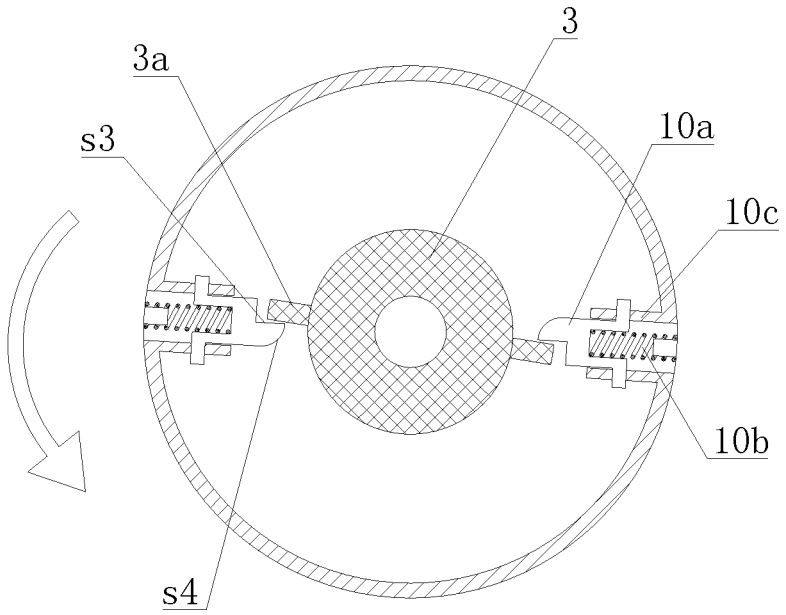
FIG. 13 is a structural schematic for the Embodiment 5 of the present invention.

As shown in FIG. 13, the direction indicated by the arrow refers to the predetermined rotating driving direction. The difference of the present embodiment from Embodiment 4 is that the elastic limiting component 10*a* can be set up in the photosensitive drum gear 10 reciprocally and movably along the radial direction of the photosensitive drum gear 10. The mounting component 10*c* is set up in the photosensitive drum gear 10 along the radial direction. The elastic limiting component 10*a* is set up on the mounting component 10*c*, and can move radially on (in) the mounting component 10*c*. The elastic structure 10*b* is set up between the elastic limiting component and the bottom wall of the mounting component 10*c* (or the inner wall of the photosensitive drum gear). The free end of the elastic limiting component 10*a* has an abutting surface s3 which is in contact with the unidirectional limiting component 3*a* on the driving cooperating component 3, and a top slope s4 connected with the abutting surface s3. The top slope s4 can be plane or arc shaped. The angle between the reciprocal moving direction of the elastic limiting component and the top slope s4 along the predetermined rotating direction is lower than 90°.

When the driving cooperating component 3 rotates around its axis in the predetermined driving rotating direction, the unidirectional limiting component 3*a* is in contact with the abutting surface s3, and thus blocked by the elastic limiting component 10*a* so that it can drive the photosensitive drum gear 10 to rotate; when the driving cooperating component 3 does not rotate around its axis in the predetermined driving rotating direction (reversely rotating), the unidirectional limiting component 3*a* is in contact with the top slope s4, and then keeps rotating along the top slope s4, thus pushing the elastic limiting component 10*a* towards the inner wall of the photosensitive drum gear. Then, the unidirectional limiting component 3*a* can smoothly pass through the elastic limiting component 10*a*. When the unidirectional limiting component 3*a* leaves the elastic limiting component 10*a*, the elastic limiting component 10*a* moves away from the inner wall of the photosensitive drum gear under the impact of the elastic structure 10*b*. In this case, the driving cooperating component 3 cannot drive the photosensitive drum gear 10 to rotate, thus realizing the unidirectional rotation purpose of the photosensitive drum.

Embodiment 6

Figure 14:
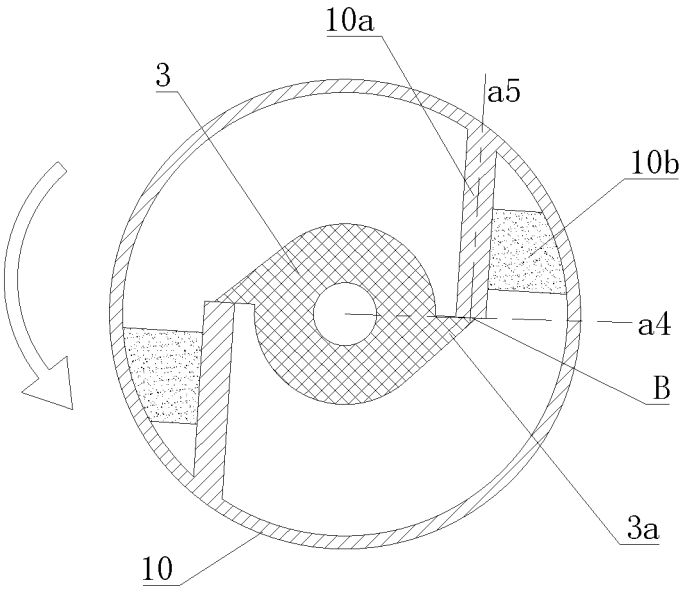
FIG. 14 is a structural schematic for the Embodiment 6 of the present invention.

As shown in FIG. 14, the direction indicated by the arrow refers to the predetermined rotating driving direction. The difference of the present embodiment from Embodiment 4 is that the elastic limiting component 10*a* is an elastic arm with one end connected to the inner wall of the photosensitive drum gear 10, and an elastic structure 10*b* is set up between the elastic limiting component 10*a* and the inner wall of the photosensitive drum gear. A unidirectional limiting component 3*a* is set up on the driving cooperating component 3*a* and protrudes out of its surface. The angle formed by the connecting line of the contact point B between the elastic limiting component 10*a* and the unidirectional limiting component 3*a* and the center line of the driving cooperating component 3 with the axis a5 of the elastic arm in the reverse direction is lower than 100°. Here, the reverse direction refers to the direction reverse to the predetermined rotating direction. When the driving cooperating component 3 rotates around its axis in the predetermined driving rotating direction (the direction indicated by the arrow in FIG. 14), the unidirectional limiting component 3*a* is in contact with the elastic arm, and thus blocked by the elastic arm so that it can drive the photosensitive drum gear 10 to rotate; when the driving cooperating component 3 does not rotate around its axis in the predetermined driving rotating direction (reversely rotating), the unidirectional limiting component 3*a* pushes the elastic arm towards the inner wall of the photosensitive drum gear, and then keeps rotating. When the unidirectional limiting component 3*a* leaves the elastic arm, the elastic arm moves away from the inner wall of the photosensitive drum gear under the impact of the elastic structure 10*b*. In this case, the driving cooperating component 3 cannot drive the photosensitive drum gear 10 to rotate, thus realizing the unidirectional rotation purpose of the photosensitive drum.

Embodiment 7

Figure 15:
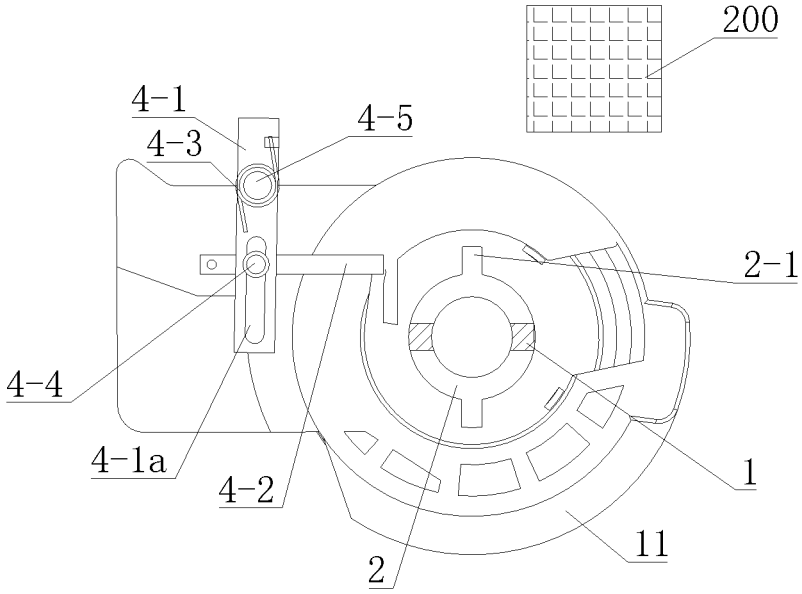
FIG. 15 is a structural schematic when the driving force receiving module does not pass through the block in the Embodiment 7 of the present invention.

As shown in FIG. 15, the difference of the present embodiment from Embodiment 1 is that there is no torsion spring on the power transmitting component, and the position adjustment device is a swing rod linkage mechanism set up on the gear cover 11. The swing rod linkage mechanism includes swing rod 4-1, connecting rod 4-2, resetting component 4-3, contact block 4-4 and rotating shaft 4-5. Swing rod 4-1 is set up on the gear cover 11 through the rotating shaft 4-5, and can rotate around the rotating shaft 4-5. A sliding groove 4-*la* is set up on the swing rod 4-1. Contact block 4-4 is connected with connecting rod 4-2, and can move in the plane perpendicular to the rotating center line of the power transmitting component. In the meanwhile, contact block is located inside the sliding groove 4-*la* on the swing rod 4-1. In the present embodiment, the contact block 4-4 is located inside the guide rail or groove (not shown) on the gear cover 11, and can move reciprocally along the guide rail or groove, which can be straight or arc. One end of the resetting component 4-3 is fixed on the gear cover 11 while the other end is connected with the swing rod 4-1 to reset the connecting rod 4-2.

Figure 16:
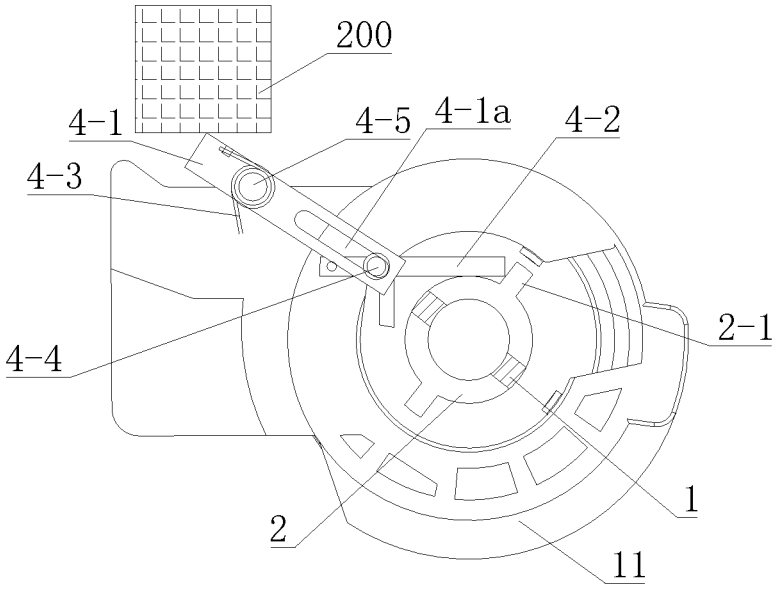
FIG. 16 is a structural schematic when the driving force receiving module passes through the block in the Embodiment 7 of the present invention.

As shown in FIG. 16, during the assembly of process cartridge, the swing rod 4-1 will be blocked by the block 200 on the machine. As the process cartridge moves in the assembly direction, the swing rod 4-1 rotates around the rotating shaft 4-5 as it is blocked by the block 200, and then pushes the contact block 4-5 to move. When the contact block 4-5 moves, the connecting rod 4-2 moves in the assembly direction of the process cartridge, thus making the connecting rod 4-2 in contact with the plug pin 2-1 on the power transmitting component 2. As the connecting rod 4-2 moves, it pushes the power transmitting component 2 to rotate around its own axis, and form an angle C by the assembly direction of the process cartridge with the connecting line of the force receiving points of two power receiving components 1, and/or avoid the projected areas of the two power receiving components from overlapping on the plane perpendicular to the assembly direction of the process cartridge. In addition, the minimum of L, which represents the distance between any two points on the projected areas of two power receiving components on the plane perpendicular to the assembly direction of the process cartridge, ranges between D/2 and D+H.

Figure 17:
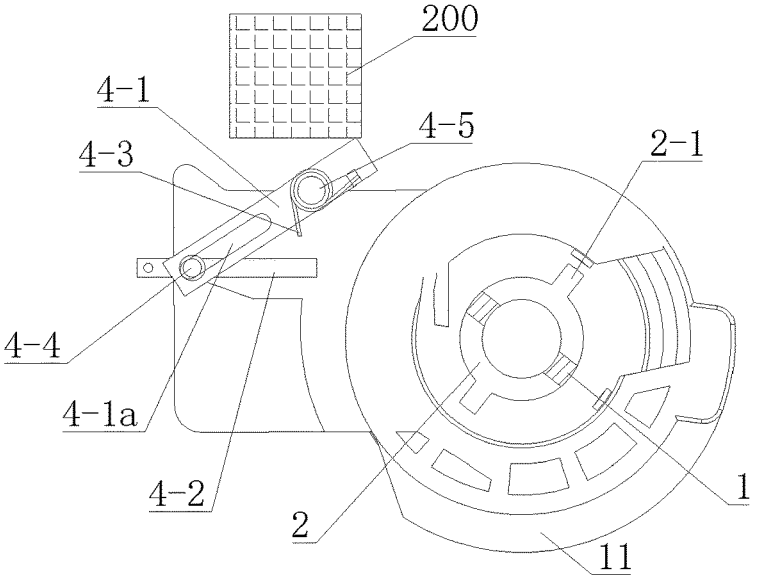
FIG. 17 is a structural schematic when the driving force receiving module passes through the block again during the disassembly process in the Embodiment 7 of the present invention.

As shown in FIG. 17, during the disassembly of the process cartridge, the swing rod 4-1 will be blocked by the block 200 on the machine. As the process cartridge moves in the disassembly direction, the swing rod 4-1 moves around the rotating shaft 4-5. In this case, the rotating direction is reverse to the rotating direction during assembly, and the contact block 4-5 is pushed to move, thus driving the connecting rod to move in the disassembly direction of the process cartridge. Then, the process cartridge can be disassembled smoothly.

Embodiment 8

Figure 18:
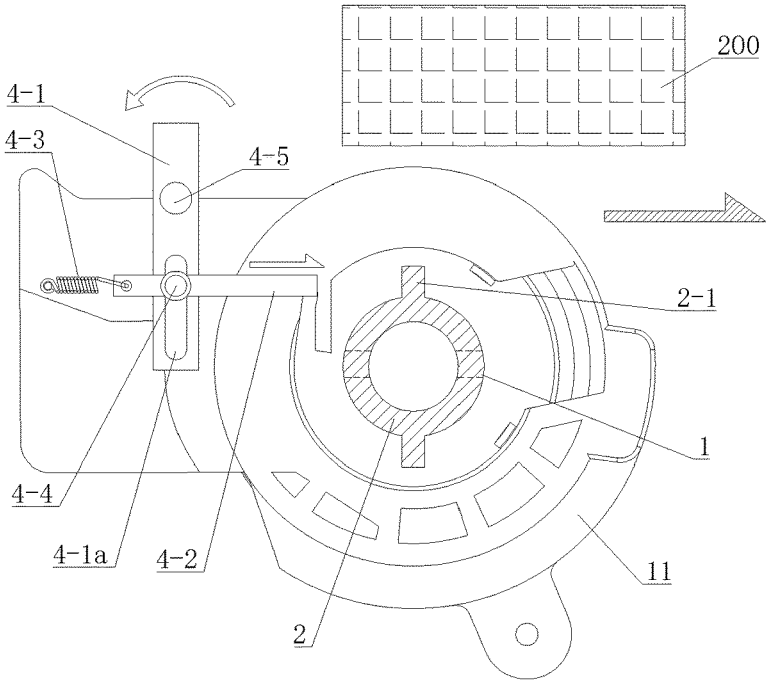
FIG. 18 is a structural schematic for the driving force receiving module in the Embodiment 8 of the present invention.

As shown in FIG. 18, the difference of the present embodiment from Embodiment 7 is that one end of the resetting component 4-3 is fixed on the gear cover 11 and the other end is connected to the connecting rod 4-2. Besides, the axis of the resetting component 4-3 is parallel to the axis of the connecting rod 4-2. When the swing rod 4-1 rotates around the rotating shaft 4-5, the contact block inside the sliding groove **4-*la* can drive the connecting rod to move in the assembly direction of the process cartridge (the direction indicated by the arrow in FIG. 18), thus making the connecting rod 4-2 in contact with the plug pin 2-1 on the power transmitting component 2 and forming an angle C by the assembly direction of the process cartridge with the connecting line of the force receiving points of two power receiving components 1**, and/or avoid the projected areas of the two power receiving components from overlapping on the plane perpendicular to the assembly direction of the process cartridge. In addition, the minimum of L, which represents the distance between any two points on the projected areas of two power receiving components on the plane perpendicular to the assembly direction of the process cartridge, ranges between D/2 and D+H.

In the present invention, the position adjusting device is set up so that when the process cartridge is assembled and about to come into contact with the driving head, the power transmitting component is at a specific location, where the assembly direction of the process cartridge perpendicular to the rotating center line of the driving head and the connecting line between the force receiving point of the power receiving component and the rotating center line of the power receiving component perpendicular to the rotating center line of the power receiving component form an angle, and/or, the projected areas of two power receiving components on the plane perpendicular to the assembly direction of the process cartridge do not overlap with each other. Besides, the minimum of L, which represents the distance between any two points on the projected areas of two power receiving components on the plane perpendicular to the assembly direction of the process cartridge, ranges between D/2 and D+H. Therefore, a space is formed in the power receiving component, which the driving head can enter smoothly, providing stable transmission of driving force.

Each part of the present specification is described in a progressive manner. Each part focuses on the differences from other parts while the same or similar parts can be referred to each other. The combination relationship of these components is not only a form disclosed in the embodiments, but the above description of the disclosed embodiments enables the professional technical staff in the art to implement or use the present invention. Various modifications to these embodiments will be readily apparent to the professional technical staff in the art. The generic principles defined herein may be realized in other embodiments without departing from the spirit or scope of the present invention. Therefore, the present invention shall not be limited to the embodiments shown herein, but the broadest scope consistent with the principles and novel features disclosed herein.

What is claimed is:

1. A driving force receiving module which is used for receiving a rotating force from a driving head of an image forming apparatus and transmitting the rotating force to a driven rotating component, thus driving the driven rotating component to rotate, comprising:

at least two symmetrically arranged power receiving components which are engaged with an engaging component of the driving head of the image forming apparatus;

a driving cooperating component which cooperates with the driven rotating component;

a power transmitting component which connects the power receiving component and the driving cooperating component; wherein the driving force receiving module is engaged with the driving head in that a minimum of L, L represents the distance between any two points on a projected area of the two symmetrically arranged power receiving components on a plane perpendicular to an assembly direction of a process cartridge, ranges from D/2 to D+H; where D is a maximum outer diameter of a rotating head perpendicular to a rotating axis of the driving head, and H is a height of the most outer point on a contour of driving head protruding out of an assembly location of the engaging component.

2. The driving force receiving module according to claim 1, wherein the driving force receiving module is engaged with the driving head by a fixed angle formed by the assembly direction of the process cartridge and a perpendicular intersecting line passing through a force receiving point of the power receiving component and a rotating center line of the power transmitting component.

3. The driving force receiving module according to claim 2, wherein the fixed angle ranges between 30° and 90°.

4. The driving force receiving module according to claim 2, wherein a position adjusting device is set up between the power transmitting component and the driving cooperating component, a first end of the position adjusting device is connected with the power transmitting component and a second end is connected with the driving cooperating component; the position adjusting device accumulates a swing potential of the position adjusting device so that the driving force receiving module is engaged with the driving head by the fixed angle formed by the assembly direction of the process cartridge and the perpendicular intersecting line passing through the force receiving point of the power receiving component and the rotating center line of the power transmitting component.

5. The driving force receiving module according to claim 4, wherein the angle ranges between 30° and 90°.

6. The driving force receiving module according to claim 1, wherein the driving cooperating component comprises a receiving cavity set up along an axis of the driving cooperating component, and the power transmitting component is set up in the receiving cavity, and an upper part of the power transmitting component protrudes out of the receiving cavity; a position adjusting device is set up between the power transmitting component and the driving cooperating component, a first end of the position adjusting device is connected with the power transmitting component and a second end is connected with the driving cooperating component.

7. The driving force receiving module according to claim 6, wherein a gear cover of the process cartridge is set up with the position adjusting device, and the position adjusting device comprises a swinging rod set up on the gear cover through a rotation shaft, a contact block movable in a plane perpendicular to a rotating center line of the power transmitting component, a connecting rod connected with the contact block, and a resetting component to reset the connecting rod; the contact block is located in a sliding groove of the swinging rod; and the connecting rod contacts with the power transmitting component under the impact of the swinging rod and the contact block.

8. A process cartridge which mounted detachably on an image forming apparatus, wherein the process cartridge comprises the driving force receiving module of claim 1.

9. A driving force receiving module which is used for receiving a rotating force from a driving head of an image forming apparatus and transmitting a rotating force to a driven rotating component, thus driving the driven rotating component to rotate, comprising:

a power receiving component which engages with an engaging component of the driving head of the image forming apparatus;

a driving cooperating component which cooperates with the driven rotating component;

a power transmitting component which connects the power receiving component and the driving cooperating component;

wherein the driving cooperating component comprises a receiving cavity set up along an axis of the driving cooperating component, and the power transmitting component is set up in the receiving cavity, and an upper part of the power transmitting component protrudes out of the receiving cavity;

a position adjusting device is set up between the power transmitting component and the driving cooperating component, a first end of the position adjusting device is connected with the power transmitting component and a second end is connected with the driving cooperating component;

wherein a gear cover of a process cartridge is set up with a position adjusting device, and the position adjusting device comprises a swinging rod set up on the gear cover through a rotation shaft, a contact block movable in a plane perpendicular to a rotating center line of the power transmitting component, a connecting rod connected with the contact block, and a resetting component to reset the connecting rod; the contact block is located in a sliding groove of the swinging rod; the connecting rod contacts with the power transmitting component under the impact of the swinging rod and the contact block.

10. The driving force receiving module according to claim 9, wherein the connecting rod contacts with the power transmitting component under the impact of the swinging rod and the contact block so that the driving force receiving module is engaged with the driving head by a fixed angle formed by an assembly direction of the process cartridge and the rotating center line of the driving head and the perpendicular intersecting line passing through the force receiving point of the power receiving component and the rotating center line of the power transmitting component.

11. The driving force receiving module according to claim 10, wherein the fixed angle ranges between 30° and 90°.

12. The driving force receiving module according to claim 9, wherein the driving cooperating component drives the driven rotating component to rotate unidirectionally.

13. The driving force receiving module according to claim 9, wherein the driving cooperating component comprises a first assembly component cooperating with the power transmitting component, and a second assembly component cooperating with the driven rotating component; the first assembly component comprises a receiving cavity set up along an axis of the first assembly component while an outer wall of the second assembly component is set up with an outward protruding fixed component cooperating with the driven rotating component, the first assembly component is set up above the second assembly component, and the first assembly component and the second assembly component are engaged by a surface gear in unidirectional engagement.

14. The driving force receiving module according to claim 9, wherein a unidirectional limiting component is set up on the driving cooperating component and protrudes out of a surface of the driving cooperating component, an elastic limiting component is set up inside the driven rotating component, a position of the elastic limiting component corresponds with a position of the unidirectional limiting component, the elastic limiting component enables the driving cooperating component to drive the driven rotating component to rotate unidirectionally.

15. The driving force receiving module according to claim 9, wherein an axial limiting structure is set up inside a photosensitive drum, and, between the driving cooperating component and an inner wall of the driven rotating component.

16. The driving force receiving module according to claim 9, wherein an axial force device is set up between the driving cooperating component and the driven rotating component.

17. The driving force receiving module according to claim 9, wherein a limiting adjusting device is set up on the gear cover, and a limiting protrusion in contact with the limiting adjusting device is set up on the power transmitting component, the limiting adjusting device is pushed against the limiting protrusion to make an axis of the power transmitting component and the driven rotating component overlap.

18. The driving force receiving module according to claim 9, wherein the driven rotating component is the photosensitive drum or a developing roller.

* * * * *